United States Patent [19]

Scheurecker

[11] 4,300,619

[45] Nov. 17, 1981

[54] STRAND GUIDE ARRANGEMENT TO BE USED IN A CONTINUOUS CASTING PLANT

[75] Inventor: Werner Scheurecker, Linz, Austria

[73] Assignee: Voest-Alpine Aktiengesellschaft, Linz, Austria

[21] Appl. No.: 69,640

[22] Filed: Aug. 27, 1979

[30] Foreign Application Priority Data

Sep. 19, 1978 [AT] Austria ..... 6752/78

[51] Int. Cl.[3] ..... B22D 11/128

[52] U.S. Cl. ..... 164/448; 164/442

[58] Field of Search ..... 164/442, 448, 82; 193/35 R; 226/189

[56] References Cited

U.S. PATENT DOCUMENTS

| | | | |
|---|---|---|---|
| 3,496,990 | 2/1970 | Meier et al. | 164/442 |
| 3,753,461 | 8/1973 | Gallucci et al. | 164/448 |
| 4,116,261 | 9/1978 | Puhringer et al. | 164/448 |

FOREIGN PATENT DOCUMENTS

| | | | |
|---|---|---|---|
| 1508859 | 12/1969 | Fed. Rep. of Germany | 164/448 |
| 1458158 | 5/1970 | Fed. Rep. of Germany . | |
| 1952633 | 4/1971 | Fed. Rep. of Germany | 164/448 |
| 7209260 | 1/1973 | Netherlands | 164/448 |

*Primary Examiner*—Gus T. Hampilos

*Attorney, Agent, or Firm*—Brumbaugh, Graves, Donohue & Raymond

[57] ABSTRACT

A strand guide for a continuous casting plant includes oppositely arranged rollers for supporting and guiding the strand. The axes or shafts of the rollers are detachably fastened to longitudinal carriers of a strand guiding stand. The longitudinal carriers are arranged between holding means supporting the axes of at least two pairs of oppositely arranged rollers, and the holding means of these oppositely arranged rollers are clamped relative to each other by centrally positioned clamping means.

6 Claims, 4 Drawing Figures

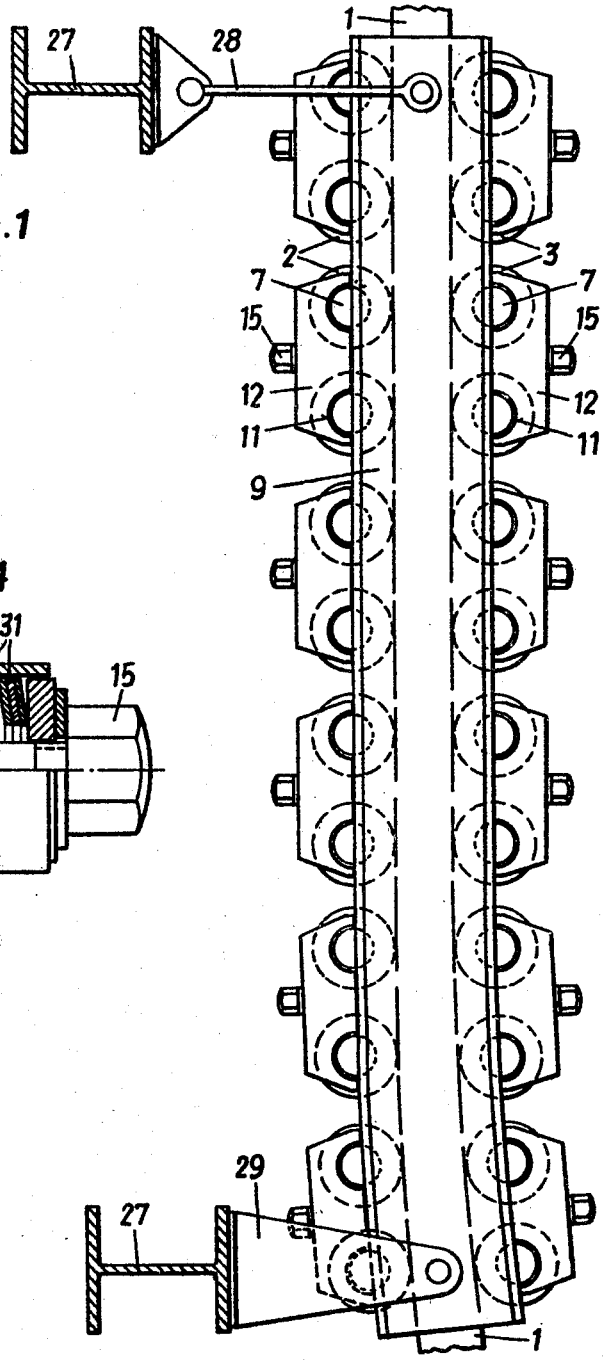
FIG.1
FIG.4
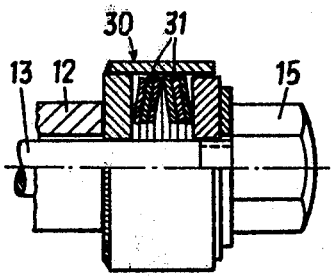

STRAND GUIDE ARRANGEMENT TO BE USED IN A CONTINUOUS CASTING PLANT

BACKGROUND OF THE INVENTION

The invention relates to a strand guide for continuous casting plants, comprising oppositely arranged rollers supporting and guiding the strand, which rollers have axes or shafts that are detachably fastened to longitudinal carriers of a strand guiding stand for holding means.

A strand guide of this kind with a straight strand guideway is known for instance from U.S. Pat. No. 4,076,069; an arcuate strand guide of this kind is disclosed in U.S. Pat. No. 3,710,847. In these strand guides, each of a plurality of rollers is held on longitudinal carriers so as to support a strand side, the longitudinal carriers being supported on their outer sides by transverse carriers. Two opposite transverse carriers are each held together by drawing anchors of any other suitable connection links. These drawing anchors or connection links accommodate the loads directly acting on the rollers and transmitted from the rollers onto the longitudinal carriers, the loads from the longitudinal carriers to the transverse carriers and the loads from the transverse carriers to the drawing anchors or connection links, respectively. These loads are for instance caused by the ferrostatic pressure of the liquid care of the strand. The advantages of this known construction are primarily to be seen in that a plurality of rollers is fastened to a longitudinal carrier, these rollers thus forming roller ways that follow the course of the longitudinal carriers without discontinuities and without buckles.

SUMMARY OF THE INVENTION

The invention aims at providing a further development of this known strand guide such that forces occurring perpendicularly to the strand guideway and exerting a load on the rollers, such as for instance forces caused by the ferrostatic pressure, are directly passed into the connection means that hold together the two strand guideways formed of the rollers, thus avoiding a load on the longitudinal and transverse carriers.

These objects are achieved according to the invention in that the longitudinal carriers are arranged between the holding means of oppositely arranged rollers and in that the holding means of oppositely arranged rollers are clamped relative to each other by clamping means.

Advantageously, the holding means each overlap two axis or shaft ends of neighbouring rollers, and the clamping means, which are designed as clamping bolts, are arranged on the holding means centrally between the two rollers, whereby a reduction of the number of clamping means, and thus a simpler assemblage of the strand guide, is possible.

For the purpose of adjusting different roller distances of oppositely arranged rollers, shims are insertable between the holding means and the roller carriers.

An overload protection for preventing damage at the rollers is advantageously achieved in that the clamping bolts are provided with an annular groove acting as a predetermined breaking site.

According to an embodiment that is particularly easy to produce and to mount, the holding means comprise semicircular recesses for accommodating flattened roller axis ends designed with a semi-circular cross section.

For facilitating the assemblage, the clamping bolts comprise centering collars.

Suitable, the clamping bolts penetrate hollow-shaped longitudinal carriers.

According to an advantageous embodiment including internally-cooled longitudinal carriers, the cavity is sealed relative to the screw bolts by means of pipes inserted in the longitudinal carriers.

According to a further advantageous embodiment, the ends of the clamping bolts are braceable relative to the holding means after interposing a spring element, whereby each roller can lift off the longitudinal carriers before cracking of the clamping bolt takes place when excessive forces occur, while still being automatically pressed back into its initial position when the excessive forces no longer occur.

BRIEF DESCRIPTION OF THE DRAWINGS

The invention will be explained in more detail by way of two embodiments illustrated in the accompanying drawings, wherein:

FIG. 1 is a side view of a curve-shaped strand guideway;

FIG. 4 illustrates a detail of a further embodiment in an illustration analogous to FIG. 3.

DESCRIPTION OF ILLUSTRATIVE EMBODIMENTS

Figure 2:
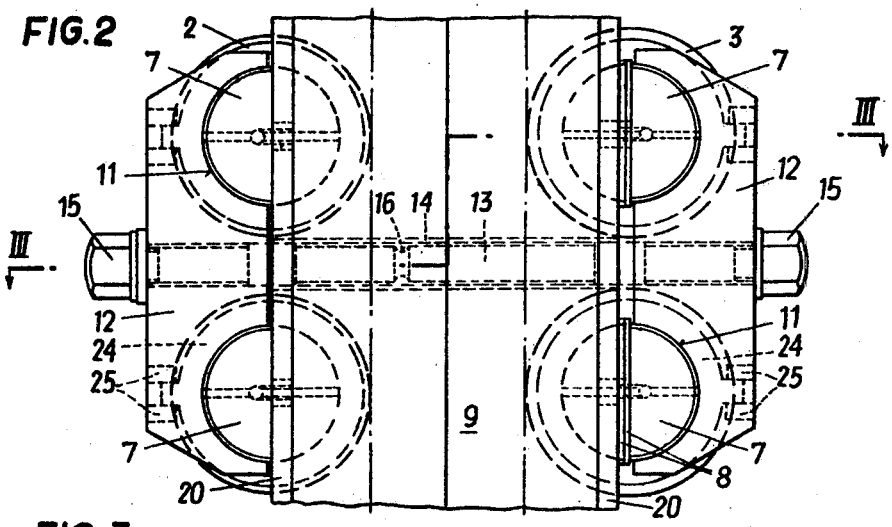
FIG. 2 is a detail of FIG. 1, on an enlarged scale.
Figure 3:
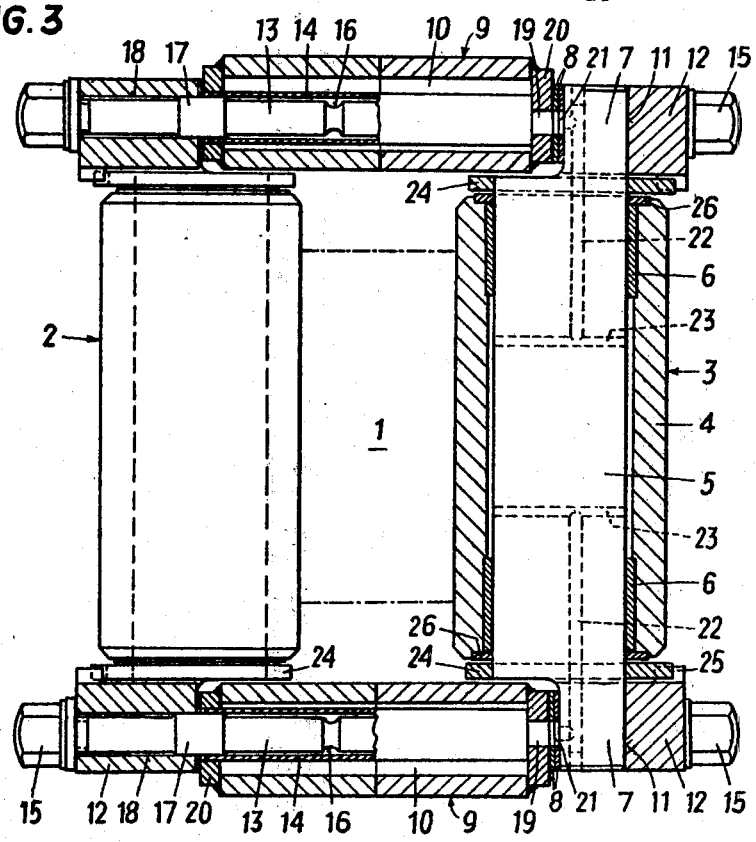
FIG. 3 shows a section according to line III—III of FIG. 2, of one embodiment.

A strand 1 is guided between two oppositely arranged strand guiding rollers 2 and 3, and is supported by the rollers. The roller bodies 4 of these rollers 2 and 3 are rotatably mounted on axis 5 by means of bearings 6. Each of the axes 5 is designed to be flattened at its ends 7 to a semi-circular cross section, the flattened face of which contacts, either directly or after interposing a shim 8, a longitudinal carrier 9 having a box-like cross section. The cavity 10 of each longitudinal carrier is passed through by a coolant.

The flattened ends 7 of the axes 5 are encompassed by holding means 12 comprising semi-circular recesses 11. Each holding means 12 is capable of accommodating two axis ends of neighbouring rollers 2 and 3, respectively. A clamping means, which according to the embodiment, is designed as a clamping bolt 13, secures two holding means each of oppositely arranged rollers 2, 3 relative to each other, the longitudinal carrier 9 being interposed therebetween. Each clamping bolt 13 projects through the holding means 12 at a position centrally located between the two semicircular recesses 11, and it passes through a pipe 14 welded in the longitudinal carrier. For fixing the holding means 12, two cap nuts 15 are provided at the ends of the clamping bolts. Wedges could also be provided there. An annular groove 16 reduces the cross section of each clamping bolt 13 to such an extent that when excessive forces occur the clamping bolt will break in the region of the groove, before the rollers 2, 3 become damaged. Furthermore, centering collars 17 are provided at the clamping bolts 13 for exact centering of the holding means 12 relative to the longitudinal carriers 9, the diameters of which collars correspond to the inner diameter of the bore 18 of the holding means 12 as well as to the inner diameter of the pipe 14.

The coolant flowing through the cavity 10 of the longitudinal carriers 9 is supplied to the roller bodies 4 and thus to the bearings 6 through bores 19 on the side wall 20 of each longitudinal carrier that faces the flattened axis end 7. From bores 19 the coolant flows through bores 21 which are in alignment with bores 19 and passes over into bores 22 of the axes 5 that extend in the axial direction. Subsequently the coolant reaches the roller bodies 4 through radially directed bores 23 connected in a conduit-like manner with the bores 22. For ensuring the rotational movement of the roller bodies 4 about the axis 5, a disc 24 is arranged at each axis end 7, which disc is secured against rotation by noses 25 provided on the holding means 12. A stop disc 26 of the bearings 6 is directed towards disc 24.

The longitudinal carriers are each articulately connected with a stationary supporting stand 27 by means of a pivotable guide rod 28, and by means of an immovable lug 29.

According to FIG. 4, in which an end of a clamping bolt 12 is shown, the cap nut 15 is pressed against the holding means, after the interposition of a spring cup 30 in which Belleville spring washers 31 are arranged, so that overloads, which may lead to damage or destruction of a roller, can be accommodated up to a certain measure by a yielding of the rollers 2, 3.

The invention is not limited to the embodiments illustrated, but can be modified in various ways. Thus, it is also possible to insert any other clamping means instead of the clamping bolt, for instance a pressure medium cylinder. It is also possible to commonly clamp, with each of the holding means, three roller axes of neighbouring rollers 2, 3 relative to the longitudinal carriers 9. The strand guide according to the invention may also be used for driven rollers, in which case the roller bearings supporting the shafts of the rollers are installed in the holding means.

What I claim is:

1. In a strand guide arrangement to be used in a continuous casting plant for casting a strand, and of the type including a strand guiding stand comprising longitudinal carriers, oppositely arranged rollers forming two roller guideways spaced from each other, said rollers having roller axes with ends, and holding means for detachably fastening said roller axes to said longitudinal carriers, the improvement which is characterized in that said longitudinal carriers are hollow so as to define a cavity therein and have side walls generally parallel to the roller axes, which side walls are arranged between the holding means for the oppositely arranged rollers, each of said holding means encompasses the ends of the roller axes of two neighboring rollers, clamping bolts are provided for clamping the holding means for oppositely arranged rollers relative to each other, said clamping bolts penetrating the cavities of the longitudinal carriers through said side walls and being centrally positioned between the two neighboring roller axes, and pipes are provided in the cavities of said longitudinal carrier and surround said clamping bolts so as to seal said bolts from the other portions of the cavities.

2. A strand guide arrangement as set forth in claim 1, further comprising a spring element and an attachment element, wherein the ends of said clamping bolts are clampable relative to said holding means by said attachment element after interposing said spring element between said holding means and said attachment element.

3. A strand guide arrangement as set forth in claim 1, further comprising shims insertable between said holding means and the longitudinal carriers for adjusting the distance of oppositely arranged rollers.

4. A strand guide arrangement as set forth in claim 1, wherein said clamping bolts are each provided with an annular groove acting as a predetermined breaking site.

5. A strand guide arrangement as set forth in claim 1, wherein the ends of said roller axes are flattened so as to have a semi-circular cross section, and wherein said holding means include semi-circular recesses for accommodating said ends of said roller axes.

6. A strand guide arrangement as set forth in claim 1, wherein said clamping bolts are provided with centering collars.

* * * * *